United States Patent [19]

Falgout, Sr. et al.

[11] Patent Number: 4,715,453

[45] Date of Patent: Dec. 29, 1987

[54] DRILLING DEVIATION CONTROL TOOL

[75] Inventors: Thomas E. Falgout, Sr., Youngsville; William N. Schoeffler, Lafayette, both of La.

[73] Assignee: Team Construction and Fabrication, Inc., Youngsville, La.

[21] Appl. No.: 924,907

[22] Filed: Oct. 30, 1986

[51] Int. Cl.[4] ..... E21B 17/10

[52] U.S. Cl. ..... 175/73; 175/325; 166/241

[58] Field of Search ..... 175/73, 76, 61, 325; 166/241

[56] References Cited

U.S. PATENT DOCUMENTS

| | | | |
|---|---|---|---|
| 3,484,141 | 12/1969 | Collett | 166/241 |
| 4,102,552 | 7/1978 | Kellner | 175/325 |
| 4,108,256 | 8/1978 | Moore, III | 175/325 |
| 4,365,678 | 12/1982 | Fitch | 175/325 |
| 4,372,622 | 2/1983 | Cheeks | 175/325 |
| 4,440,241 | 4/1984 | Anders | 175/325 |
| 4,606,417 | 8/1986 | Webb et al. | 175/325 |

FOREIGN PATENT DOCUMENTS

| | | | |
|---|---|---|---|
| 2625093 | 8/1977 | Fed. Rep. of Germany | 175/325 |

*Primary Examiner*—Stephen J. Novosad
*Assistant Examiner*—William P. Neuder
*Attorney, Agent, or Firm*—John D. Jeter

[57] ABSTRACT

A body, functioning as a length of drill string, has an eccentric roller mounted for rotation around the body. The roller and body have cooperating cam surfaces that cause the roller to reciprocate axially when the body rotates relative to the roller. In use, the extended radius of the eccentric roller engages the near side of the well bore walland tends to become stationary relative to earth. The forced axial motion of the retarded roller induces some peripheral motion at each turn of the drill string. The eccentric roller turns freely with the drill string when the extended radius is adjacent the far side of the well bore wall. The extended radius of the roller tends to spend most of the drilling time between the drill string and the near side, or low side, of the well bore to aid in well bore deviation control.

17 Claims, 6 Drawing Figures

DRILLING DEVIATION CONTROL TOOL

This invention pertains to rotary well drilling drill string components generally and more particularly pertains to drill string components that engage a well bore wall to influence the location of the drill string rotational axis relative to a well bore general centerline.

BACKGROUND OF THE INVENTION

A rotary drill string used to drill wells normally experiences column loading near the drill head and tends to bend to some extent to form a curve in the axis of drill string rotation. Unless influenced by stabilizers, the curve of the drill string will allow the drill head, or bit, to produce a curve in the progressing well bore being drilled.

In many cases, those skilled in the art of well drilling will use the tendency of the drill string to curve for constructive purposes. Directional drillers place stabilizers at strategic intervals along the lower drill string assembly to urge the curve to direct the progressing drill bit along a preferred path. Such directional control has become a highly specialized field of endeavor.

Once the hole being drilled is progressing along a preferred path, whether vertical or deviated, holding the preferred path may become quite difficult. To maintain a preferred path and avoid unwanted deviation of the progressing well bore, several drill string components may be used to engage the well bore wall and use the existing well bore for guidance. Some such arrangements are called "packed hole" assemblies.

Except for the drill head, all other drill string components are obliged to be somewhat undergage to allow the drill string to move axially along the well bore to avoid jamming, or "sticking" in the hole. Downhole assemblies must allow flow space between drill string and well bore for upwardly moving drilling fluid and cutting produced by the drill head.

Even with packed hole assemblies, the necessary well bore clearance allows some curvature of the drill string. In tilted formations, the continuous drill string curvature produces continuous well bore deviations. The curved drill string tends to lie along the low side of a deviated well bore, above the drill head and may compound the problem.

Several attempts have been made to place eccentric rollers around drill string elements above the bit to engage the hole wall nearest the drill string to urge the drill string axis of rotation away from the hole near side to produce a straighter hole, when the tendency of the hole to drift from a planned path was experienced. Most notable is probably the apparatus of U.S. Pat. No. 4,220,213. Some beneficial results have been realized but the apparatus may become passive and produce no influence. The bearings in the eccentric rollers often allow the eccentric roller to become stationary at the first obstruction and fail to achieve results. Bearing resistances, or drag, used to encourage the eccentric roller to be more active do not respond to changing hole conditions and, again, the results are not predictable.

There is a need for some device to relate changing hole conditions to the tendency for the eccentric system to act a greater percentage of down hole time against the hole low side to displace the drill string centerline away from the hole low side wall.

It is therefore an object of this invention to provide apparatus to urge a rolling element mounted on a drill string interval to tend to rotate with the drill string an amount proportional to the rotating resistance encountered by the roller from the well bore wall.

It is a further object of this invention to provide a roller mounted on a drill string interval that has limited peripheral surfaces that are radially overgage to become wedged between the drill string and the well bore near side wall, yet be compelled to move some peripheral amount with each revolution of the drill string.

It is yet another object of this invention to provide a roller mounted for rotation on a drill string interval that will spend more time between the drill string and the near side of the well bore wall and turn freely with the drill string when negotiating the peripheral distance around the well bore wall farthest from the drill string.

It is still another object of this invention to provide an eccentric rolling element mounted for rotation on a drill string interval that utilizes resistance to axial motion of the roller along the well bore wall, to force the roller to move a smaller amount peripherally with each turn of the drill string, when peripheral movement of the roller is more resisted, and to move a larger amount peripherally with each turn of the drill string when peripheral movement of the roller is less resisted.

It is yet a further object of this invention to provide apparatus to space a drill string rotational centerline from a well bore wall that will reciprocate axially as the drill string rotates relatively to reduce the tendency to cause ledges on the well bore wall and to more easily negotiate existing ledges as drilling progresses.

These and other objects, advantages, and features of this invention will be apparent to those skilled in the art from a consideration of this specification, including the attached drawings and appended claims.

SUMMARY OF THE INVENTION

A form of drill string stabilizer has at least one roller mounted for rotation around a body. The body is a length of drill string. The roller is generally eccentric in shape and rotates around an axis generally parallel or coincident with the body rotational centerline. When the body rotates relative to the roller, the roller is forced to reciprocate axially relative to the drill string centerline.

Cooperating cam surfaces on the body and roller force reciprocation. The preferred axial camming arrangement uses a tilted groove around the body periphery, followed by a lug on the roller.

The roller has a radial projection wrapping part of the periphery, having some effect of eccentricity. In use, the projection will hit the near side of the well bore wall and stop rotation of the roller. The drill string will then rotate relative to the roller and axial reciprocation will result.

The roller experiences axial drag on the well bore wall and this takes torque from the drill string. The torque will cause the roller to move some peripherally on the well bore wall on each axial excursion. The roller slowly works around the near side wall, then rotates freely with the drill string around the clear, or more distant wall periphery. The roller spends more time against the near side wall, pushing the drill string centerline away from that wall, than it spends adajcent the far side wall. The result is a more controlled well bore.

BRIEF DESCRIPTION OF DRAWINGS

In the drawings, wherein like reference characters are used throughout to designate like parts.

DETAILED DESCRIPTION OF DRAWINGS

Figure 1:
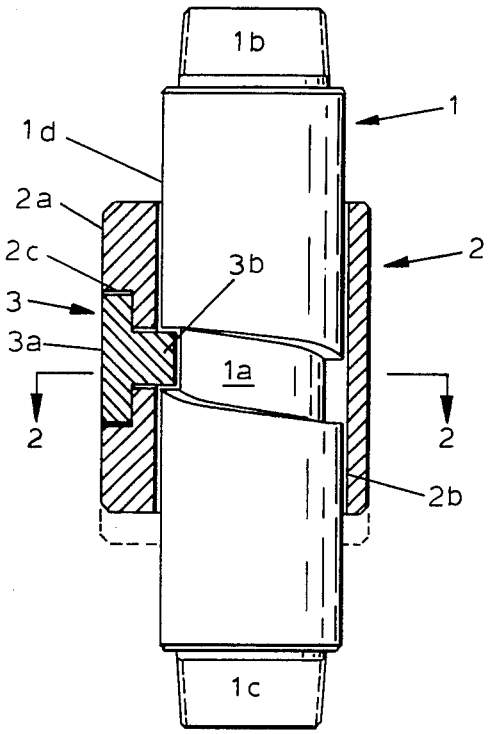
FIG. 1 is a side elevation, partly cutaway, of the preferred embodiment of the invention.

FIG. 1 represents the preferred embodiment of the invention. Body 1 is a drill string interval, or short length often called a sub, with the usual drill string connections at each end. Tool joint pins 1*b* and 1*c* are shown. In the cylindrical midsection 1*d*, groove 1*a* extends peripherally around the body. Groove 1*a* is shown to progress axially as it progresses peripherally. The groove is, in essence, an axial continuous cam. Sleeve 2 has cylindrical bore 2*b* that serves as a bearing with mating surface 1*d*. The sleeve is free to rotate relative to the body.

Groove follower 3 is secured in an opening 2*c* in the sleeve and projects into the groove 1*a*. The projection 3*b* may be called a cam follower, and moves peripherally along groove 1*a*, as the sleeve rotates on the body. Follower 3*b*, operating in groove 1*a*, causes the sleeve to reciprocate axially as the sleeve rotates on the body. Groove configuration is a subject of continuing development, and there seems to be advantage in using some axial clearance between follower and groove to cause abrupt axial motion of the sleeve. A more serpentine shape groove yields the same effect and is considered best for use in drilling some formations.

One net effect of the groove and follower is to produce a force vector on the sleeve that has a peripheral and axial component if considered to lie along the outer surface of the sleeve, when the sleeve is in contact with and sliding on a well bore wall. The sleeve is forced to slide on the well bore wall and, ideally, the force vector producing the forced axial motion will also produce some peripheral motion. The axial excursion is fixed for any particular assembly, but the peripheral motion should be positive; but will, ideally, be a small increment for each axial excursion, when the sleeve is dragging on the well bore wall. The needed peripheral component of the force vector depends upon the formation and well bore condition, but the available force vector is determined largely by the configuration of the groove. In this respect, the impact of the backlash, or free motion, between groove and follower serves a purpose. A serpentine groove has much the same effect. A planned inventory of tools will include several groove configurations, each being preferred for particular drilling situations.

The sine wave groove shown in FIG. 1, with some free motion between groove and follower, is considered a general purpose arrangement and an ideal arrangement for smooth well bores.

Figure 2:
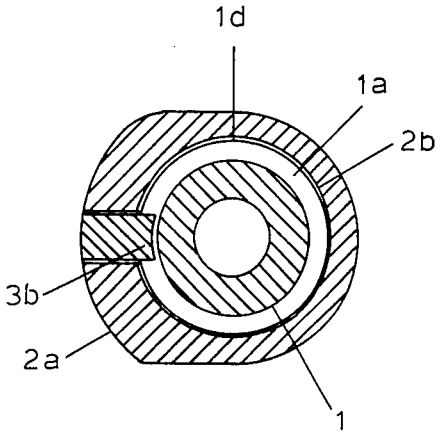
FIG. 2 is a sectional view taken along line 2—2 of FIG.1.

FIG. 2 shows the shape of sleeve 2 most preferred. The radial projection 2*a* has a limited wall engagement peripheral dimension. The radius of the projection may actually be overgage. The projection is only slightly overgage if the sleeves 2 are used in stacked pairs. Sleeves can be paired by using two independent tools in close assembly, but two independent sleeves or more may be installed on the same body constructed for that purpose.

The sleeve bore and body outer surface perform well as radial bearings. Mud lubrication is adequate for the low unit loads experienced in use. The groove surfaces wear some, and wider followers are used for rework as required.

Figure 3A:
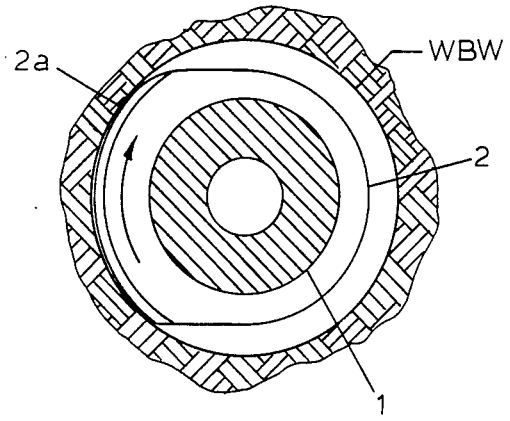
FIG. 3A is a top view of the preferred embodiment in a well bore, with the drill string sectioned just above the tool.
Figure 3B:
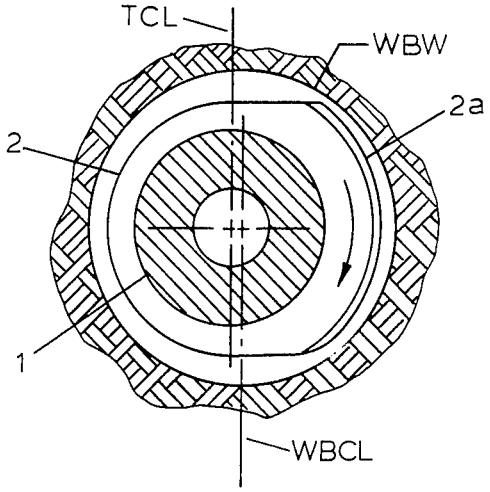
FIG. 3B is a view identical to FIG. 3A, with the tool rotated 180 degrees in the well bore.

FIGS. 3A and 3B are views from above the tool of FIG. 1, and rotation is in the direction of the arrows. In FIG. 3A, the projection 2*a* is in contact with the low side of the well bore wall WBW. Body 1 is held in the approximate center of the well bore as body 1 rotates within sleeve 2. Axial motion of roller 2 is forced and the resulting rotational drag, relative to the body, induced by the axial camming system causes some rotation of the roller relative to the well bore each turn of the body.

In FIG. 3B, the projection 2*a* has moved free of the near side wall of the well bore. The tool centerline TCL has moved toward the low side of the well bore centerline WBCL. Roller 2 is free to rotate because the projection 2*a* is clear of the well bore wall. The roller will rotate with the body until it again encounters the well bore wall on the near side.

Figure 4:
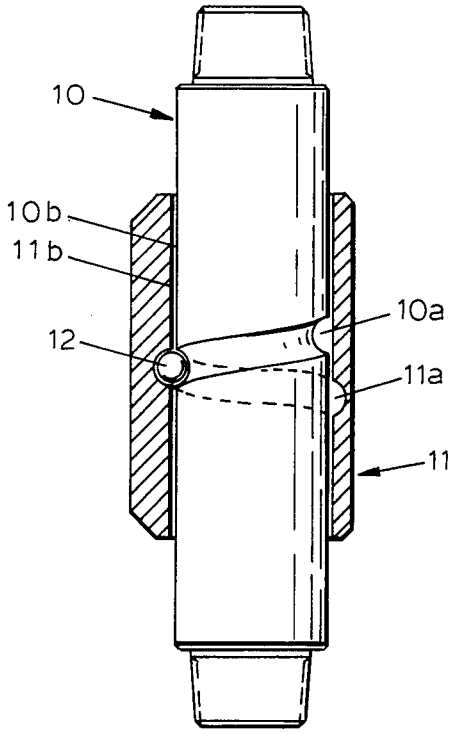
FIG. 4 is a side elevation, partly cut away, of an alternate embodiment of the tool.

FIG. 4 represents an alternate embodiment that functions much the same as the tool of FIG. 1 by different processes. Body 10 has means at both ends as shown to attach to continuing drill string elements. Cylindrical outer surface 10*b* serves as a mating bearing surface for the cylindrical bore 11*b* of roller 11. Cam grooves 10*a* and 11*a* open such that ball 12 can roll peripherally around the axially displaced grooves provided the roller is axially positioned to place the opposed grooves in registry at the ball location.

When body 10 is rotated relative to roller 11, the roller is forced to reciprocate axially to accomplish the effect already described herein.

Figure 5:
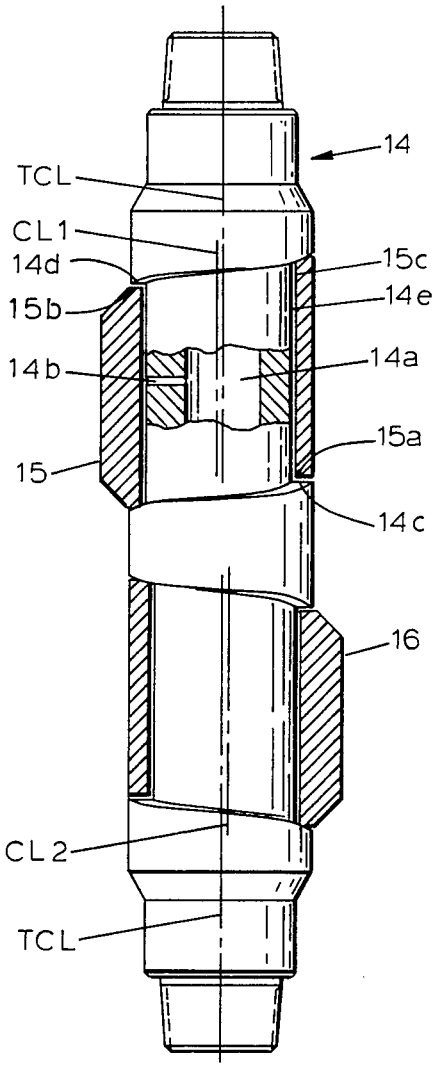
FIG. 5 is a side elevation, partly cut away, of an embodiment using a plurality of active elements on one body.

FIG. 5 shows two rollers, 15 and 16, mounted on the body 14 and shows bearing eccentricities and axial camming arrangements usable on the device of FIG. 1. Cam surfaces 14*c* and 14*d* oppose roller cam surfaces 15*a* and 15*b* and cause the rollers to axially reciprocate as the body rotates relatively.

Cylindrical surface 14*e* is eccentric relative to the body centerline, shown by centerlines CL1 and TCL respectively. Roller bore 15*c* operates on surface 14*e* and causes radial reciprocation of the roller as the body rotates relatively.

Roller 16 is supported as described for roller 15, but the similar eccentric arrangement is 180 degrees out of phase with the eccentric arrangement for roller 15, as shown by the centerlines TCL and CL2.

As shown, the axial camming arrangements are oppositely phased and the roller projections will normally assume the relationships shown when the body is vertical and not rotating. If overgage roller projections are used, the axial camming systems will be arranged to be in phase so that the roller projections will favor the same side of the tool as the tool goes in the well bore. The overall tool then will be undergage. Both rollers will periodically be thrust against the well bore wall, but periodically, they will also be undergage because of the opposed eccentricities. The projection on the high side will more freely rotate in the well and, hence, both rollers will spend most of the time on the low side.

The roller 2 of FIG. 2 is a sleeve that is heavy on the side of projection 2a, In slightly deverted wells, the weight imbalance favors orientation such that projection 2a tends to spend more time on the low side of the drill string centerline, which is commonly also the well bore wall nearest the drill string or simply the bore wall near side. That arrangement is desirable. As well bores become more horizontal, the eccentric weight of roller, or sleeve, 2a may resist rising from the emerging side of the wall drag interval. It can reciprocate axially but not rotate around the far side interval. The groove can be made more serpentine to function properly until a greater angle of hole is encountered.

At some time, the amount of horizontal component of the well bore angle will cause eccentric weighted rollers to fail to work. For these applications, the thin side of the roller is made thicker, and the radial projection is made lighter by drilling axially directed holes in projection 2a. Radial projection 2a is retained, somewhat less severe, but the roller may be balanced about the drill string centerline. In extreme cases of well bore angularity, approaching horizontal, a plurality of balanced rollers in close proximity become more advantageous.

Tools of this invention are usable in conjunction with conventional drill string stabilizers spaced some axial distance away. The effects of such stabilizers and their strategic placement relative to the drill head vary with down hole conditions but are familiar to those skilled in the art of well bore control. The axial repiprocation of rollers alleviate a historic problem associated with the use of conventional stabilizers. Conventional stabilizers tend to wear ledges in the well bore wall, then resist slipping axially over the ledges. This produces a stick and slip situation that complicates efforts to maintain uniform bit loads as drilling progresses.

The axial reciprocation of rollers of this invention, with or without radial reciprocation, have less tendency to create ledges and more readily negotiate those ledges already present. This is especially useful farther up the well bore where ledges have had more time to develop.

From the foregoing, it will be seen that this invention is one well adapted to attain all of the ends and objects hereinabove set forth, together with other advantages which are obvious and which are inherent to the method and apparatus It will be understood that certain features and subcombinations are of utility and may be employed without reference to other features and subcombinations. This is contemplated by and is within the scope of the claims.

As many possible embodiments may be made of the apparatus and method of this invention without departing from the scope thereof, it is to be understood that all matter herein set forth or shown in the accompanying drawings is to be interpreted as illustrative and not in a limiting sense.

The invention having been described, we claim:

1. A well drilling tool for use in a drill string assembly to aid in well bore control, the tool comprising:

(a) a body comprising a drill string length;

(b) at least one roller means situated on said body, arranged to engage a well bore wall and situated to rotate around said body;

(c) axial reciprocator means operatively associated with said body and said roller to urge said roller to reciprocate axially relative to said body when said body rotates relative to said roller.

2. The tool of claim 1 wherein said roller means has at least one surface extending radially some distance relative to the rotational centerline of said body, beyond the general radial dimension of said roller means.

3. The tool of claim 1 wherein said reciprocating action is produced by at least one continuous peripheral groove around said body, engaged by at least one groove follower surface structurally associated with said roller, said groove being of such configuration that said roller is urged to reciprocate axially relative to said body when said body rotates relative to said roller means.

4. The tool of claim 1 wherein said reciprocating action is produced by at least one continuous groove around the periphery of said roller, engaged by at least one groove follower surface structurally associated with said body, said groove being of such configuration that said body is urged to reciprocate axially relative to said roller when said body rotates relative to said roller means.

5. The tool of claim 1 wherein said reciprocator means comprises at least one rolling element captured in opposed peripheral grooves, one of said grooves being in said body surface, opening toward said roller, and one of said grooves being in said roller surface, opening toward said body, at least one of said grooves progessing axially as it progresses peripherally, both grooves being continuous.

6. The tool of claim 5 wherein said rolling element is a ball.

7. The tool of claim 2 wherein said roller means is unbalanced, in terms of weight distribution, about said roller centerline, toward said projection.

8. The tool of claim 2 wherein said roller means is balanced, in terms of weight distribution, about the rotational centerline of said roller means.

9. The tool of claim 1 wherein said body has a cylindrical surface of some length about which said roller means rotates in the manner of a sleeve bearing.

10. The tool of claim 1 whereing said reciprocator means comprises opposed cam surfaces on said body and on said roller means, said cam surfaces operatively associated such that said roller will reciprocate axially relative to said body when said body rotates relative to said roller.

11. The tool of claim 1 wherein said roller means is situated to rotate around an axis that is displaced some radial distance from the rotatiaonl centerline of said body.

12. The tool of claim 11 wherein a plurality of roller means are situated to rotate around said body, each roller means independently associated with a reciprocator means.

13. The tool of claim 12 wherein at least one of said roller means is situated to rotate about a centerline displaced some radial amount from the rotational centerline of at least one other of said roller means.

14. The tool of claim 1 wherein at least one of said roller means has a surface positioned radially overgage for the well size for which it is dimensioned.

15. The tool of claim 1 wherein said reciprocator means comprises at least one groove follower means secured in an opening in said roller and situated to extend radially into a receptive groove in a surface in said body.

16. The tool of claim 1 wherein said roller means is situated in the manner of a sleeve bearing around said body, for relative rotation, and wherein at least one fluid channel extends from the fluid conducting bore of said body through the body wall, opening into the space between said sleeve bearing surfaces.

17. The tool of claim 16 wherein said roller inner sleeve surface is contoured to direct fluid, emerging from said channel, into selected areas of the space between said sleeve bearing surfaces.

* * * * *